US006861790B1

(12) United States Patent
Iwasa et al.

(10) Patent No.: US 6,861,790 B1
(45) Date of Patent: Mar. 1, 2005

(54) ELECTRONIC ELEMENT

(75) Inventors: Takashi Iwasa, Wako (JP); Junzo Ishikawa, Kyoto (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/537,723

(22) Filed: Mar. 30, 2000

(30) Foreign Application Priority Data

Mar. 31, 1999 (JP) ..... 11-090844
Jun. 17, 1999 (JP) ..... 11-170637

(51) Int. Cl.[7] ..... H01J 1/30
(52) U.S. Cl. ..... 313/346 R; 313/310; 313/311; 428/408; 428/702
(58) Field of Search ..... 313/309–311, 351, 313/336, 326, 495, 346 R; 428/408, 471, 702

(56) References Cited

U.S. PATENT DOCUMENTS 5,463,271 A * 10/1995 Geis et al. ..... 313/346 R
5,703,435 A * 12/1997 Kumar et al. ..... 313/495
5,821,680 A * 10/1998 Sullivan et al. ..... 313/310
5,852,303 A * 12/1998 Cuomo et al. ..... 257/9
5,908,699 A * 6/1999 Kim ..... 428/408
6,127,773 A * 10/2000 Kumar et al. ..... 313/309
6,274,881 B1 * 8/2001 Akiyama et al. ..... 257/10
6,376,123 B1 * 4/2002 Chu ..... 429/104
6,472,814 B1 * 10/2002 Yamanobe et al. ..... 313/495
6,554,673 B2 * 4/2003 Pehrsson et al. ..... 445/50

* cited by examiner

*Primary Examiner*—Ashok Patel
(74) *Attorney, Agent, or Firm*—Arent Fox

(57) ABSTRACT

An electric element is formed of a deposited film containing cesium (Cs) and has a plurality of conical projections on its surface. The projections are formed of cesium oxide and have an average height h in a range of 10 nm≦h≦500 nm. The electronic element is used as a cold cathode element, and has a high practicality, and for example, emits electrons sufficiently even with a low voltage applied thereto.

19 Claims, 14 Drawing Sheets

ELECTRONIC ELEMENT

BACKGROUND OF THE INVENTIONS

1. Field of the Invention

The present invention relates to an electronic element, and, more particularly, to an electronic element used as a cold cathode element that emits electrons with application of an electric field.

2. Description of the Related Art

Hot and cold cathode elements are conventionally known as electron emitting elements.

The hot cathode element, which can be represented by a vacuum tube, suffers from a problem that it is difficult to integrate, because of the heat produced. On the other hand, the cold cathode element can be applied to a flat panel display, a voltage amplifying element, a high frequency amplifying element and the like as an element which is capable of being integrated, since heat is not used.

SUMMARY OF THE INVENTION

Accordingly, it is an object of the present invention to provide an electronic element of the above-described type, which has a high practicality, e.g., a capability to emit electrons sufficiently even when only a low voltage is applied, for example, when it is used as a cold cathode element.

To achieve the above object, according to an exemplary embodiment of the present invention, there is provided an electronic element which is formed of a deposited film containing cesium (Cs) and having a plurality of projections made of cesium oxide on a surface thereof.

Cesium (Cs) is the largest in ion radius (0.181 nm) and in metallic bond radius (0.266 nm) among elements. Therefore, if cesium is present in the vapor-deposited film, a distortion is produced in the film, such that the electric insulating properties of the deposited film, namely, of the electronic element can be reduced, on the one hand, while the electric conductivity of the deposited film can be increased, on the other hand. Cesium is present at a plurality of points not only contained inside of the deposited film, but also on the surface of the deposited film. In this case, cesium present on the surface of the film combines with oxygen in the air to form stable cesium oxide, since cesium is active. The cesium oxide is extremely fine, but forms projections.

In a cold cathode element including such an electronic element, the electric field emitted from the element is reduced and hence, even if the voltage applied to the cold cathode element is lowered, a sufficient emission of electrons can be realized.

According to the present invention, there is also provided an electronic element comprising a main body which is formed of an amorphous film of carbon and contains a metal element having a metallic bond radius equal to or larger than two times the atom radius of carbon (C), and a surface layer which covers the main portion and is formed of an amorphous film of carbon having a high $sp^3$ hybridization.

If the metal element having a metallic bond radius as described above is present in the main body formed of the amorphous film of carbon, a distortion is produced in the inside of the main body. Thus, the electric insulating property of the main body can be reduced, on the one hand, while the electric conductivity of the main body can be increased, on the other hand. The amorphous film of carbon constituting the surface layer and having the high $sp^3$ hybridization originally has an excellent electric-field emitting characteristic. In a cold cathode element including such an electric element, the electric field emitted from the element is lowered and hence, even if the voltage applied to the cold cathode element is lowered, a sufficient emission of electrons can be realized.

The above and other objects, features and advantages of the invention will become apparent from the following description of the preferred embodiments taken in conjunction with the accompanying drawings.

DESCRIPTION OF THE PREFERRED EMBODIMENTS

The present invention will now be described by way of exemplary embodiments with reference to the accompanying drawings.

Figure 1:
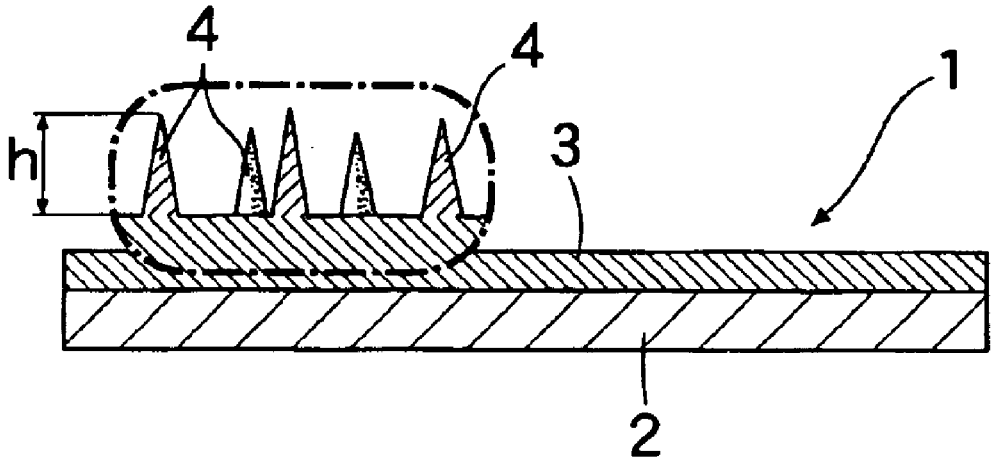
FIG. 1 is a sectional view of a first exemplary embodiment of a cathode unit according to the present invention.

FIG. 1 shows a first embodiment of an exemplary cathode unit 1. The cathode unit 1 is comprised of a cathode plate 2 made of, for example, aluminum (Al), and a cold cathode element 3 as an electronic element, which is formed on a surface of the cathode plate 2. The cold cathode element 3 is formed of a vapor-deposited film containing cesium and has a plurality of very fine conical projections 4 composed of cesium oxide on the surface thereof. The deposited film is, for example, an amorphous film of carbon, in this embodiment, and the conical projections 4 have, for example, an average height h in a range of $10\ nm \leqq h \leqq 500$ nm and, preferably, in a range of $10\ nm \leqq h \leqq 100$ nm; and more preferably in a range of $20\ nm \leqq h \leqq 60$ nm.

Cesium (Cs) is the largest in ion radius (0.181 nm) and in metallic bond radius (0.266 nm) among elements. Therefore, if cesium is present in the amorphous film of carbon, a distortion is produced in the inside of the film. Thus, the electric insulating property of the amorphous film of carbon, namely, the cold cathode element 3 can be reduced, on the one hand, while the electric conductivity of the cold cathode element 3, can be increased, on the other hand. Cesium is present at a plurality of points not only within the deposited film, but also on the surface of the deposited film. Active cesium on the surface of the film combines with oxygen in the air to form stable cesium oxide. The cesium oxide is extremely fine, but forms the conical projections 4. Further, cesium in the film has the effect of decreasing the work function of carbon (C).

In such a cold cathode element 3, the electric field emitted from the element 3 is lowered and hence, even if the voltage applied to the cold cathode element 3 is lowered, a sufficient emission of electrons can be realized.

However, if the average height h of the conical projections 4 is smaller than 10 nm, no effect is provided. On the other hand, if the average height h of the conical projections 4 is larger than 500 nm, the distortion in the surface of the element and in the vicinity thereof is increased, and as a result, cracks are liable to be produced in the cold cathode element 3.

In order to provide an effect as described above, it is preferable that the content of Cs in the amorphous film of carbon is set, for example, in a range of 0.1% by atom $\leqq$Cs$\leqq$5.0% by atom and, preferably, in a range of 0.5% by atom $\leqq$Cs$\leqq$2.0% by atom and, more preferably, in a range of 0.75% by atom $\leqq$Cs$\leqq$1.25% by atom. In this case, if the Cs content is smaller than 0.1% by atom, the cesium has little or no effect. On the other hand, if the Cs content is larger than 5.0% by atom, the distortion in the film is too large, and as a result, the $sp^3$ hybridization of the film is reduced. For this reason, the emission of an electric field by the affinity of the film for negative electrons cannot be expected.

The amorphous film of carbon may be used as a simple component and moreover, may be also used as a material for forming a layer for covering the surface of, for example, a cold cathode element made of silicon in order to enhance the performance of the cold cathode element.

The amorphous film of carbon can be formed by an ion beam depositing process. In forming the amorphous film of carbon, cesium can be contained uniformly in the amorphous film of carbon by using cesium ions as incident ions and by regulating the forming conditions. In the ion beam deposition process, a positive or negative ion beam can be used. In this case, the density of atoms forming the amorphous film of carbon becomes higher in the order of those provided by the positive ion beam deposition process and the negative ion beam deposition process. Namely, the electric conductivity becomes higher in this order, and the electric field emitted becomes lower in this order. Such a difference between densities of atoms is due to the reason that the internal potential energy (electron affinity) of negative ions is lower than the internal potential energy (ionization potential) of positive ions.

Particular examples will be described below.

Figure 2:
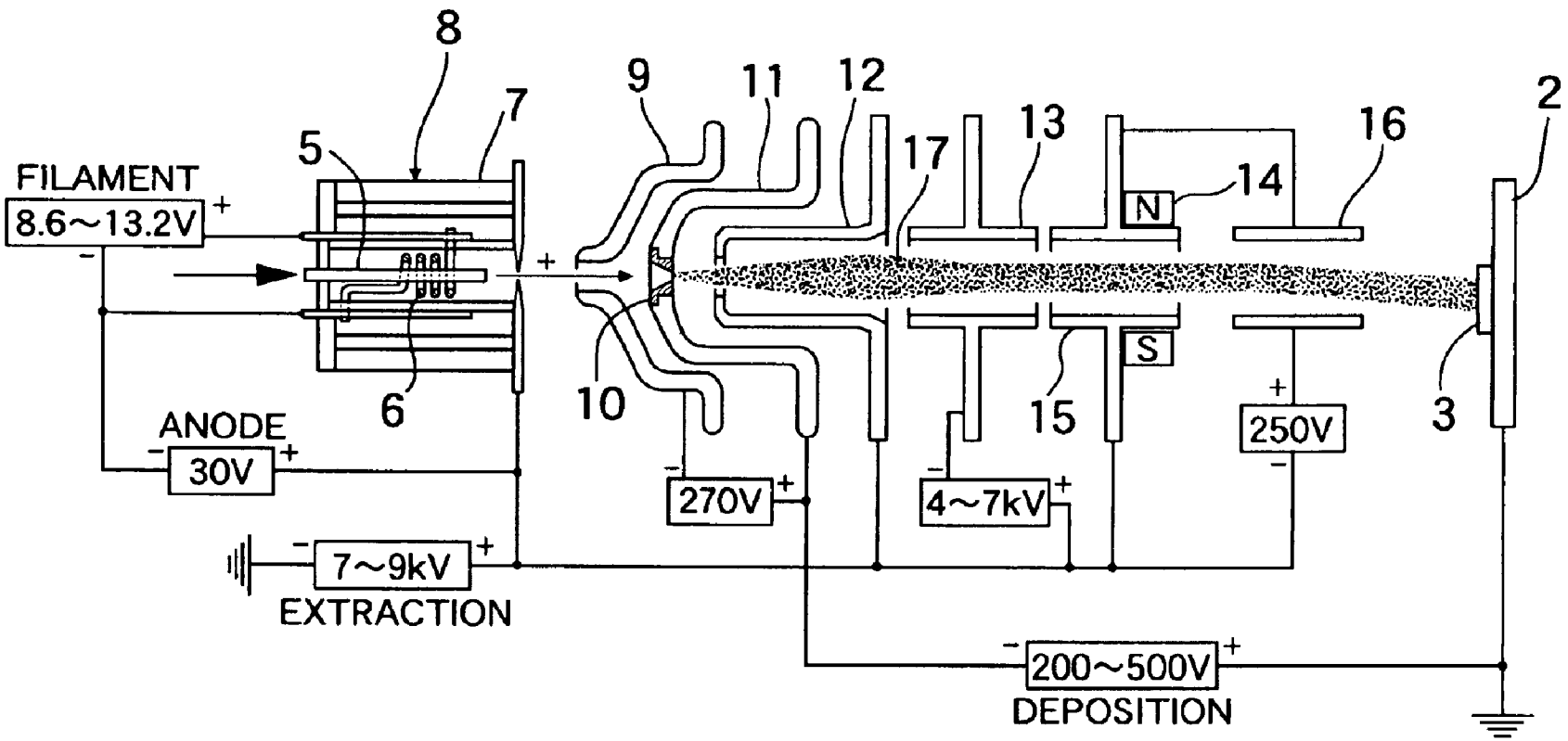
FIG. 2 is a diagrammatic illustration of an ultra-high vacuum type negative ion beam depositing apparatus.

FIG. 2 shows a known ultra-high vacuum type negative ion beam depositing apparatus (e.g., a neutral and ionized alkaline metal bombardment type heavy negative ion source (NIABNIS)). This apparatus includes a cesium plasma ion source 8 having a center anode pipe 5, a filament 6, thermal shields 7 and the like, a suppressor 9, a target electrode 11 having a target 10 made of high-purity and high-density carbon, a negative-ion extraction electrode 12, a lens 13, an electron remover 15 having a magnet 14, and a deflector 16.

To form an amorphous film of carbon 3 (for convenience, this film is designated by the same reference numeral as that designating the cold cathode element), a process was employed which comprises the steps of (a) applying a predetermined value of voltage at each of portions of the apparatus shown in FIG. 2, (b) producing positive ions of cesium (Cs) by the Cs plasma ion source 8, (c) sputtering the target 10 by the positive ions of cesium to produce negative ions of carbon (C) or the like, (d) extracting negative ions by the negative-ion extraction electrode 12 through the suppressor 9 to produce a negative ion beam 17, (e) converging the negative ion beam 17 by the lens 13, (f) removing electrons contained in the negative ion beam 17 by the electron remover 15, and (g) deflecting only the negative ions toward the cathode plate 2 by the deflector 16.

Figure 3:
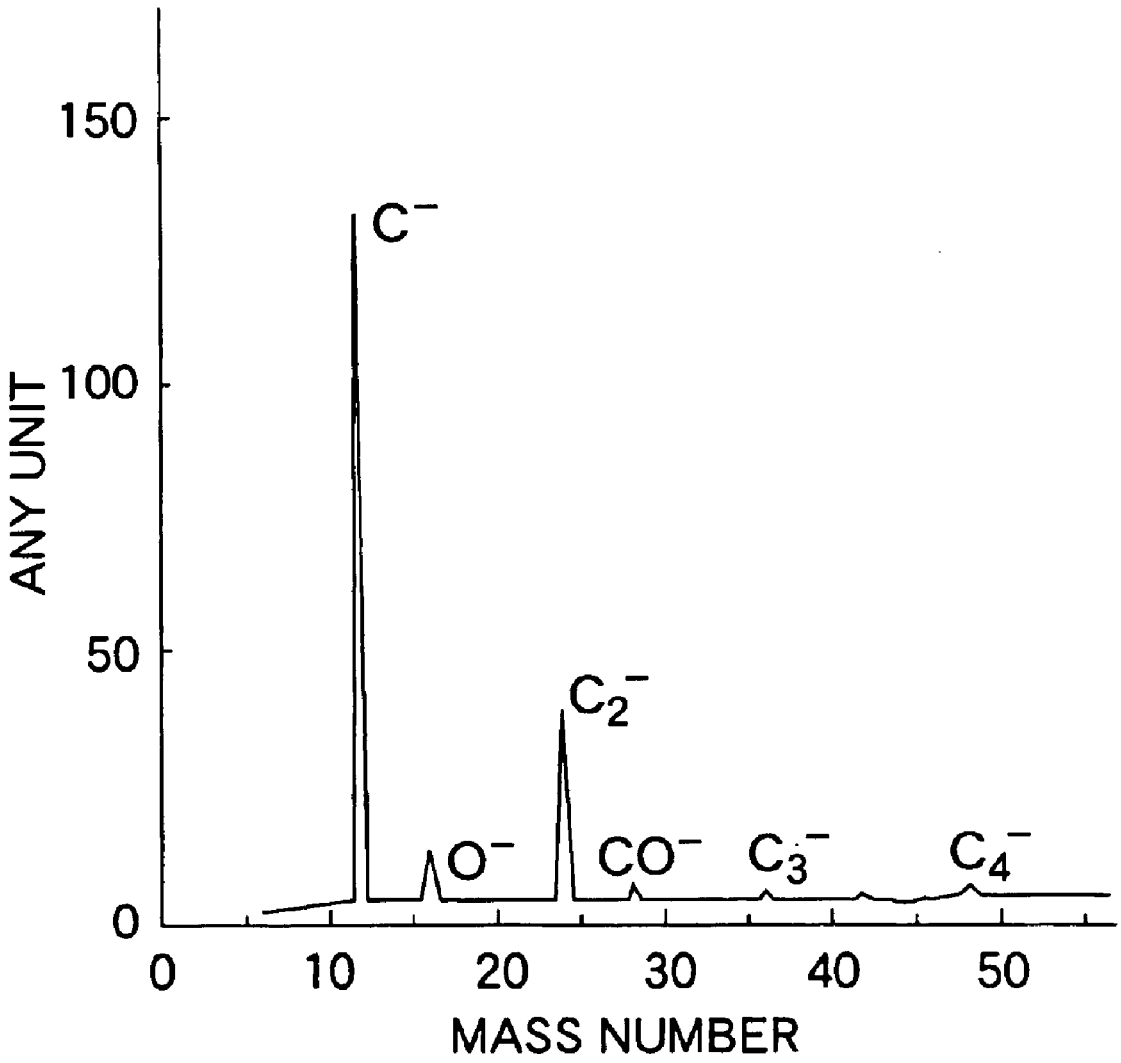
FIG. 3 is a beam spectrum provided by the apparatus shown in FIG. 2.

FIG. 3 shows a mass spectrum of the negative ion beam 17. The primary negative ions in the negative ion beam 17 are $C^-$ions having a constituent atom number of 1, and $C_2^-$ions having a constituent atom number of 2. However, the ion current of $C^-$is larger than that of $C_2^-$.

Table 1 shows forming conditions in examples A1 to A4 of amorphous films of carbon 3 formed by the negative ion beam deposition process. The thickness of each of the examples A1 to A4 was in a range of 0.4 to 0.8 $\mu$m.

TABLE 1

| Amorphous film of carbon | Deposition voltage (V) | Extracting voltage (kV) | Voltage-current (V-A) of filament |
|---|---|---|---|
| Example A1 | 500 | 8 | 10.7–20.2 |
| Example A2 | 200 | 7 | 8.6–17.6 |
| Example A3 | 200 | 9 | 9.5–18.0 |
| Example A4 | 500 | 8 | 13.2–22.4 |

Figure 4:
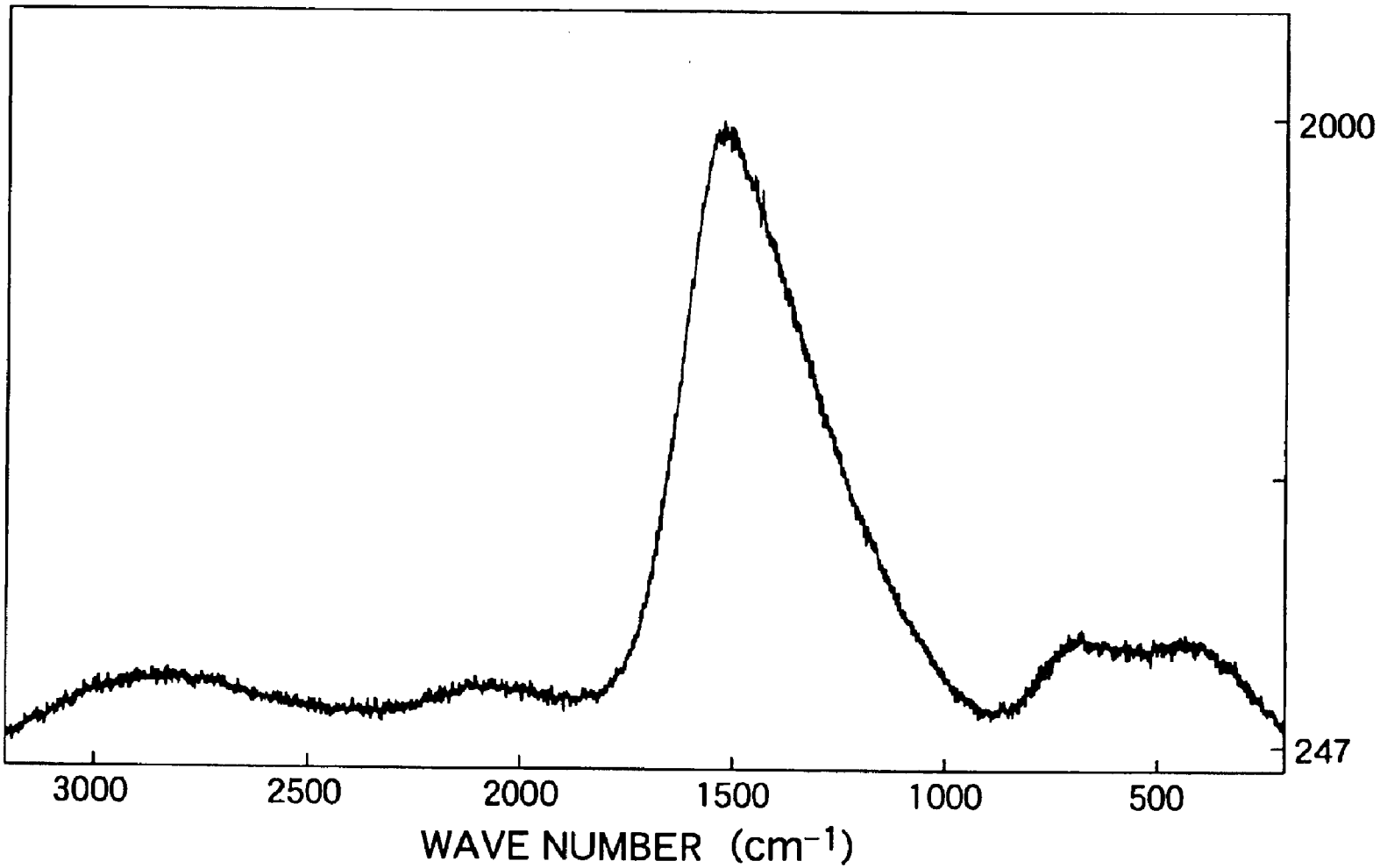
FIG. 4 is a chart showing results of a Raman spectroscopic analysis of an amorphous film of carbon.

Then, substantially central portions of the examples A1 to A4 were subjected to a Raman spectroscopic analysis to examine whether they were amorphous. FIG. 4 shows a result of the analysis of the example A2, where a broad Raman band about the vicinity of a wavelength equal to 1,500 $cm^{-1}$ is observed. It was ascertained from this result that the example A2 was amorphous. In the cases of the other examples A1, A3 and A4, results similar to that in FIG. 4 were obtained.

The content of Cs in each of the examples A1 to A4 was examined by an XPS (X-ray Photoelectron Spectroscopy) quantitative analysis. As a result, it was ascertained that each of the examples A1 to A3 contained cesium (Cs), but that the example A4 contained no cesium.

Figure 5:
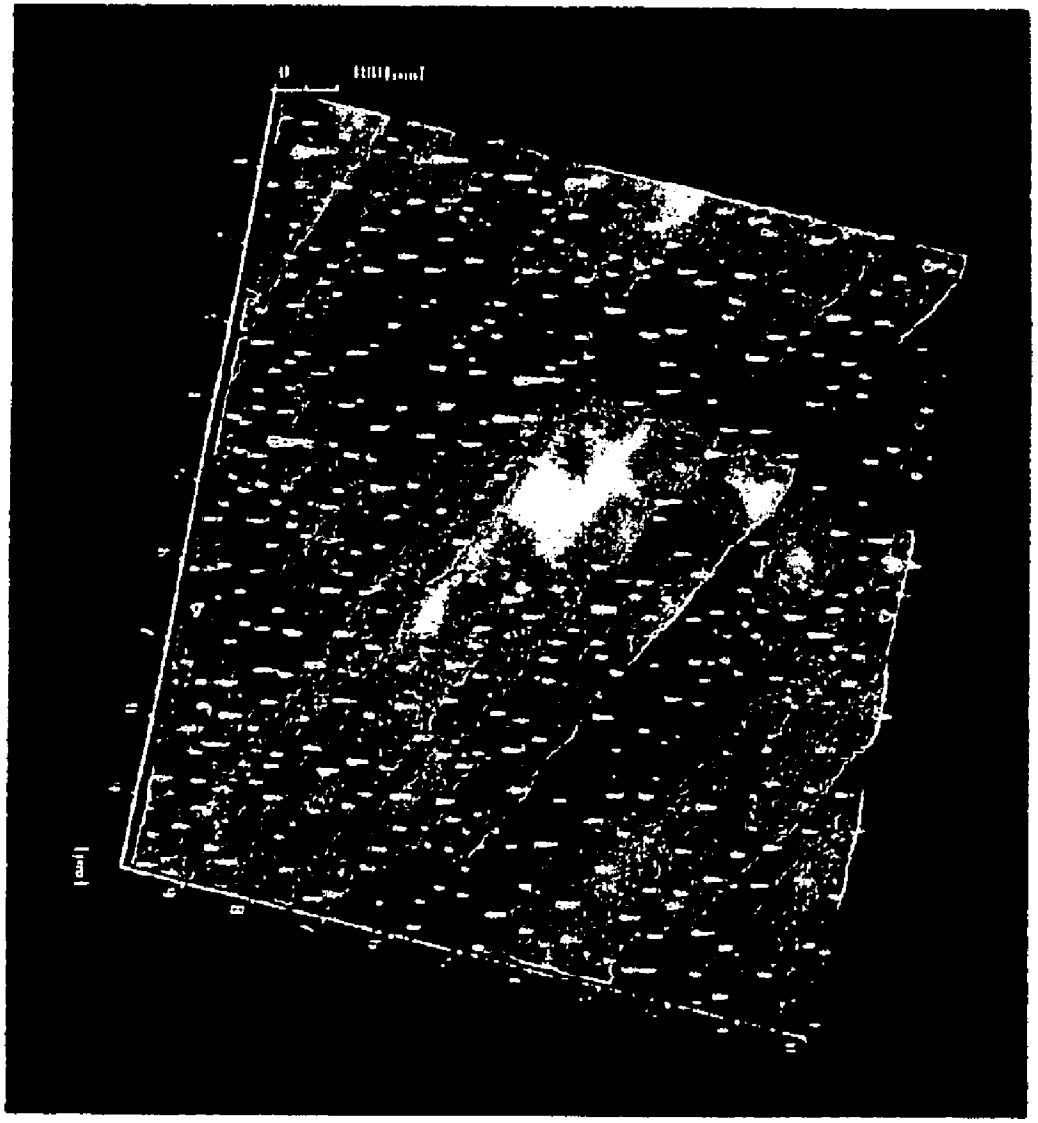
FIG. 5 is a photograph of the surface of the amorphous film of carbon by an interatomic force microscope.
Figure 6:
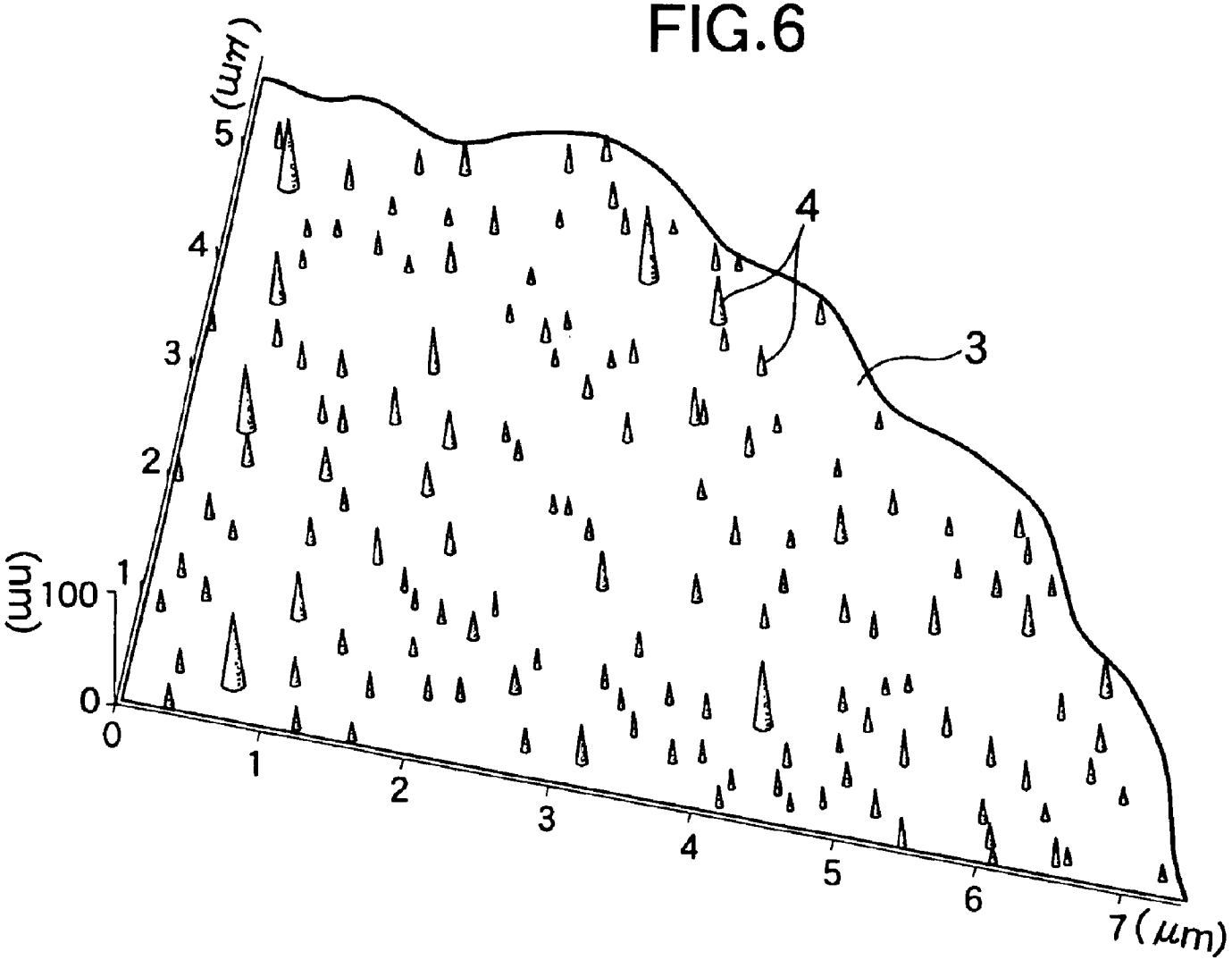
FIG. 6 is an enlarged tracing of an essential portion of the surface shown in FIG. 5.

Further, photographs of surfaces of the examples A1 to A4 were taken by an interatomic force microscope (AFLM). FIG. 5 is the photograph of the surface of the example A2, and FIG. 6 is an enlarged tracing of an essential portion of the surface of the example A2. In these Figures, a large number of conical projections 4 dotted on the surface of the amorphous film 3 of carbon are formed of cesium oxide. In the cases of the other examples A1 and A3, results similar to that shown in FIG. 5 were obtained. An average height of the conical projections 4 in each of the examples A1 to A3 was determined from these photographs of the surfaces.

Figure 7:
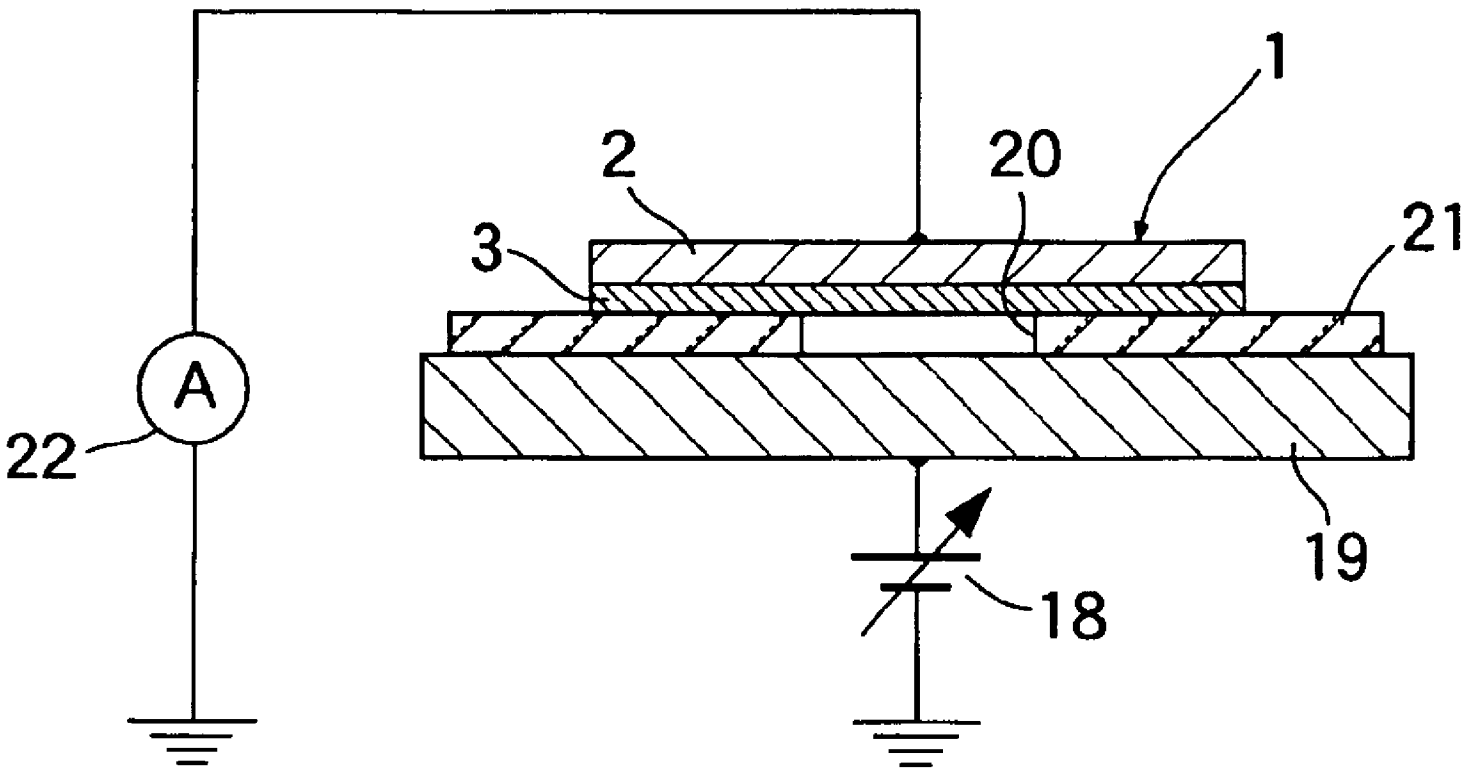
FIG. 7 is a view for explaining an emitted electric field measuring method.

Further, the measurement of the electric field emitted in each of the examples was carried out by a method shown in FIG. 7. More specifically, a conductive plate 19 of aluminum was connected to a voltage-regulatable power source 18, and a cover glass sheet 21 having a thickness of 150 $\mu$m and provided at its central portion with an opening 20 having a length of 0.8 cm and a width of 0.8 cm (an area of 0.64 $cm^2$)

was placed onto the conductive plate 19. An amorphous film of carbon 3 of a cathode unit 1 was placed onto the cover glass sheet 21 and further, an ammeter 22 was connected to the cathode plate 2. Then, a predetermined value of voltage was applied from the power source 18 to the conductive plate 19, and a value of current was read by the ammeter 22. An emitted current density ($\mu A/cm^2$) was determined from the measured value of current and the area of the opening 20. When the emitted current density reached 8 $\mu A/cm^2$, the emitted electric field (V/$\mu$m) was determined from the voltage corresponding to such emitted current density and the thickness of the cover glass sheet 21.

Table 2 shows the Cs content, the average height h of the conical projections 4 and the emitted electric field for each of the examples A1 to A4.

TABLE 2

| Amorphous film of carbon | Cs content (% by atom) | Average height h (nm) of conical projections | Emitted electric field (V/$\mu$m) |
|---|---|---|---|
| Example A1 | 1.2 | 60 | 0.91 |
| Example A2 | 0.98 | 45 | 1.3 |
| Example A3 | 0.78 | 20 | 3.2 |
| Example A4 | 0 | — | 9.3 |

As apparent from Table 2, the emitted electric field in each of the examples A1 to A3 having the plurality of projections formed of Cs oxide on the surface thereof is extremely low, as compared with the example A4 having no projection 4.

Figure 8:
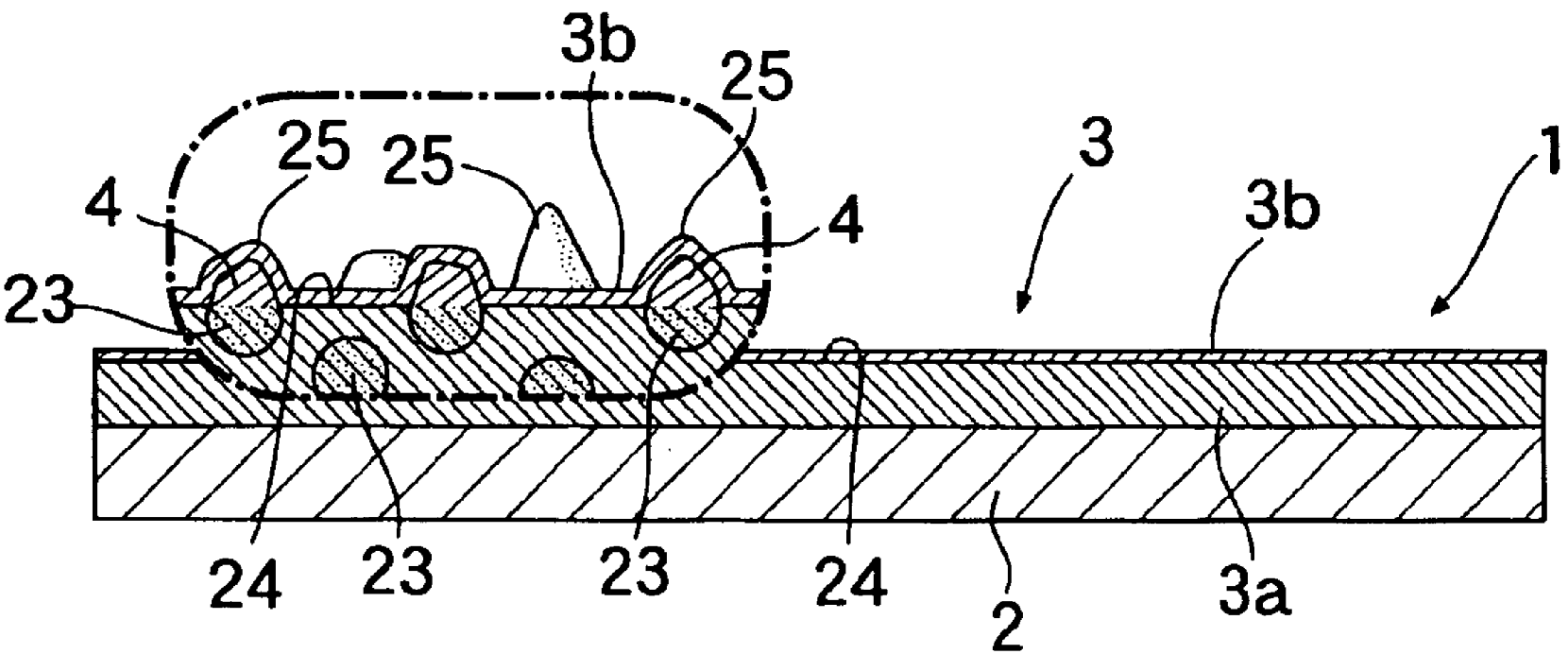
FIG. 8 is a sectional view of a second exemplary embodiment of a cathode unit according to the present invention.
Figure 9:
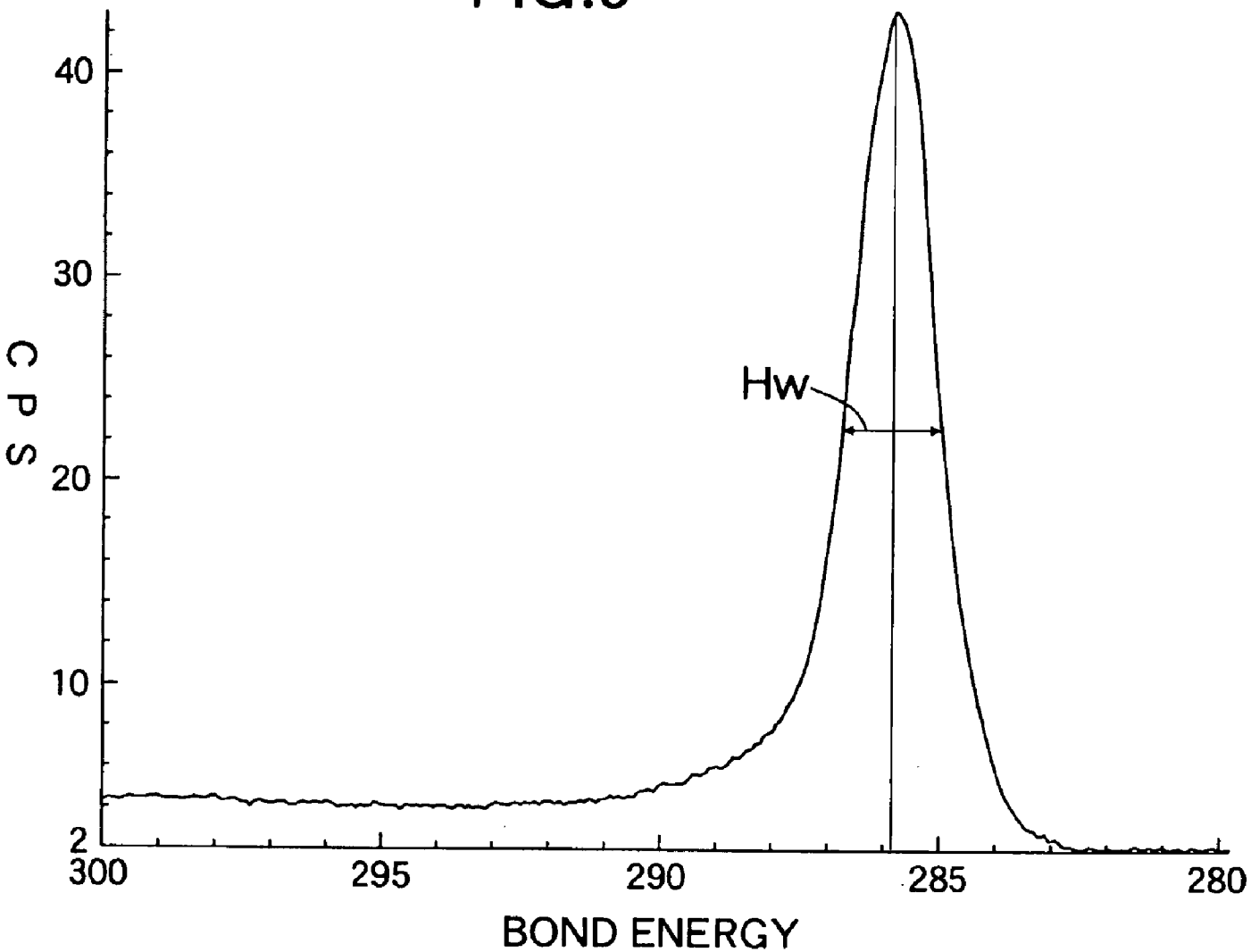
FIG. 9 is a photoelectron spectrum of $C_{15}$ electron by an X-ray photoelectron spectroscopic analysis conducted for a surface layer of the cathode unit.

FIG. 8 shows a second exemplary embodiment of a cathode unit 1. The cathode unit 1 is comprised of a cathode plate 2 of aluminum, and a cold cathode element 3 as an electronic element which is formed on a surface of the cathode plate 2. The cold cathode element 3 includes a main body 3*a* which is formed of an amorphous film of carbon and contains a metal element 23 having a metallic bond radius equal to or larger than two times the atom radius of carbon (C), and a surface layer 3*b* which is bonded to the main body 3*a* and formed of an amorphous film of carbon having a high $sp^3$ hybridization.

If the metal element 23 having the above-described metallic bond radius is present in the main body 3*a* formed of the amorphous film of carbon, a distortion is produced in the inside of the main body 3*a*. Thus, the electric insulating property of the main body 3*a* can be reduced, on the one hand, while the electric conductivity of the main body 3*a* can be increased, on the other hand. The metal element 23 is also present at a plurality of points at an interface 24 of the main body 3*a* to the surface layer 3*b*. In this case, the metal element 23 in the interface 24 combines with oxygen in the air to form a stable oxide, because the metal element 23 is active. The oxide is extremely fine, but produces projections 4. As a result, the surface layer 3*b* has a plurality of protrusions 25 that conform to the projections 4. The amorphous film of carbon forming the surface layer 3*b* and having the high $sp^3$ hybridization originally has an excellent electric field emitting characteristic. An electric field concentrating effect is applied to the amorphous film of carbon by the protrusions 25 and hence, the electric field emitting characteristic of the surface layer 3*b* is further enhanced.

In such a cold cathode element 3, the electric field emitted therefrom is lowered. Therefore, even if the voltage applied to the cold cathode element 3 is lowered, a sufficient emission of electron can be realized.

The atom radius of carbon is 0.077 nm and hence, cesium (Cs) having a metallic bond radius of 0.266 nm, rubidium (Rb) having a metallic bond radius of 0.247 nm and the like may be used as the metal element 23.

In the surface layer 3*b*, it is desirable that a half-value width Hw of a photoelectron spectrum of $C_{15}$ electron by an X-ray photoelectron spectroscopic analysis (ESCA, XPS) is equal to or smaller than 2.0 eV (Hw≦2.0 eV). The half-value width Hw is determined from the photoelectron spectrum of $C_{15}$ electrons obtained by carrying out the X-ray photoelectron spectroscopic analysis of the surface layer 3*b*. Namely, the spectrum width (eV) which is one half of a peak value is defined as the half-value width Hw. If the half-value width Hw is set at a value as described above in the surface layer 3*b*, the emitted electric field can be lowered.

The amorphous film of carbon having a two-layer configuration is also used as a material for forming a surface covering layer, for example, of a cold cathode element made of silicon (Si) in order to enhance the performance of the cold cathode element.

The main body 3*a* and the surface layer 3*b* are formed by an ion beam deposition process. In forming each of the main body 3*a* and the surface layer 3*b*, cesium ions are used as incident ions, and cesium used as the metal element 23 can be contained uniformly in the main body 3*a* by regulating the forming conditions. In the ion beam deposition process, a positive or negative ion beam may be used. In this case, the density of atoms forming the main body 3*a* and the like becomes higher in an order of those provided by the positive ion beam deposition process and the negative ion beam deposition process. Namely, the electric conductivity becomes higher in this order, and the electric field emitted becomes lower in this order. Such a difference between densities of atoms is due to the reason that the internal potential energy (electron affinity) of negative ions is lower than the internal potential energy (ionization potential) of positive ions.

Particular examples will be described below.

The formation of the main body 3*a* and the surface layer 3*b* can be carried out using the ultra-high vacuum type negative ion beam depositing apparatus shown in FIG. 2.

To form the main body 3*a*, a process was employed which comprises, as in the first exemplary embodiment, the steps of (a) applying a predetermined value of voltage to each of portions of the apparatus, (b) producing positive ions of cesium (Cs) by the Cs plasma ion source 8, (c) sputtering the target 10 by the positive ions of cesium to produce negative ions of carbon or the like, (d) extracting negative ions by the negative-ion extraction electrode 12 through the suppressor 9 to produce a negative ion beam 17, (e) converging the negative ion beam 17 by the lens 13, (f) removing electrons contained in the negative ion beam 17 by the electron remover 15, and deflecting only the negative ions toward the cathode plate 2 by the deflector 16.

The mass spectrum of the negative ion beam 17 is as shown in FIG. 3. The primary negative ions in the negative ion beam 17 are $C^-$ ions having a constituent atom number of 1, and $C_2^-$ions having a constituent atom number of 2. However, the ion current of $C^-$is larger than that of $C_2^-$.

Figure 10:
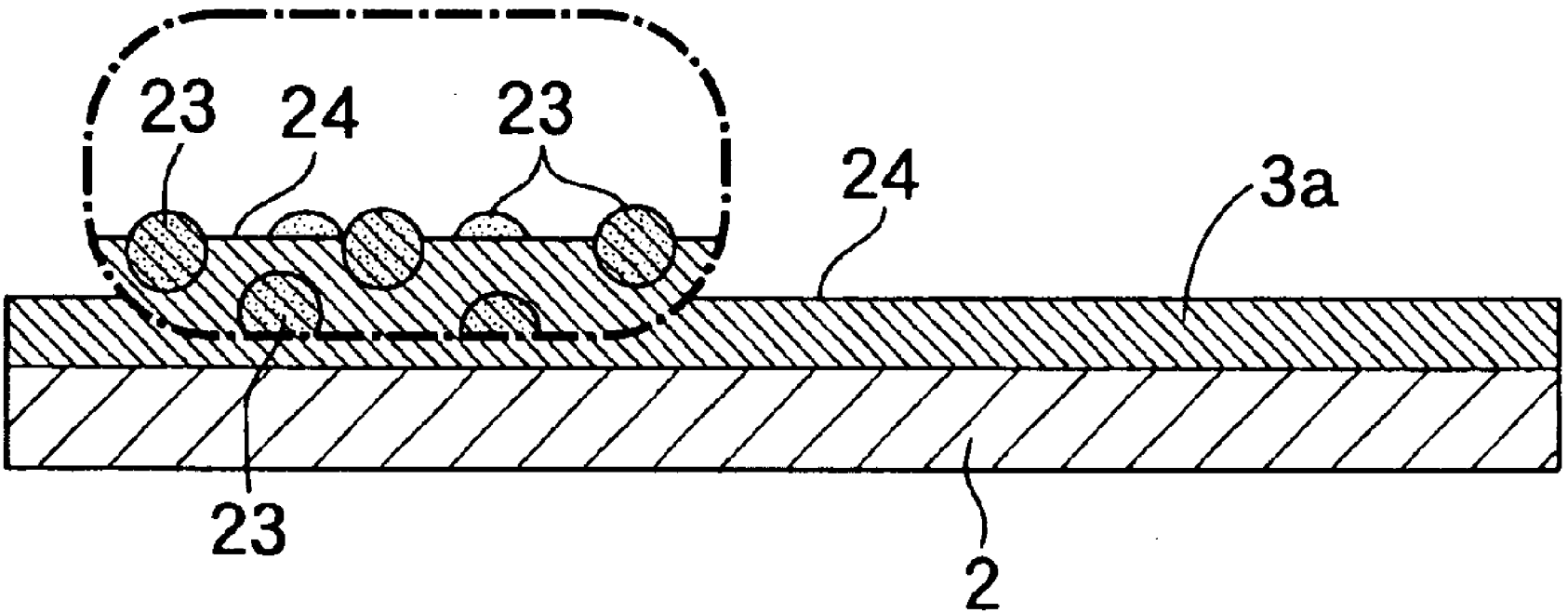
FIG. 10 is a view of a main body of the cathode unit immediately after being formed.
Figure 11:
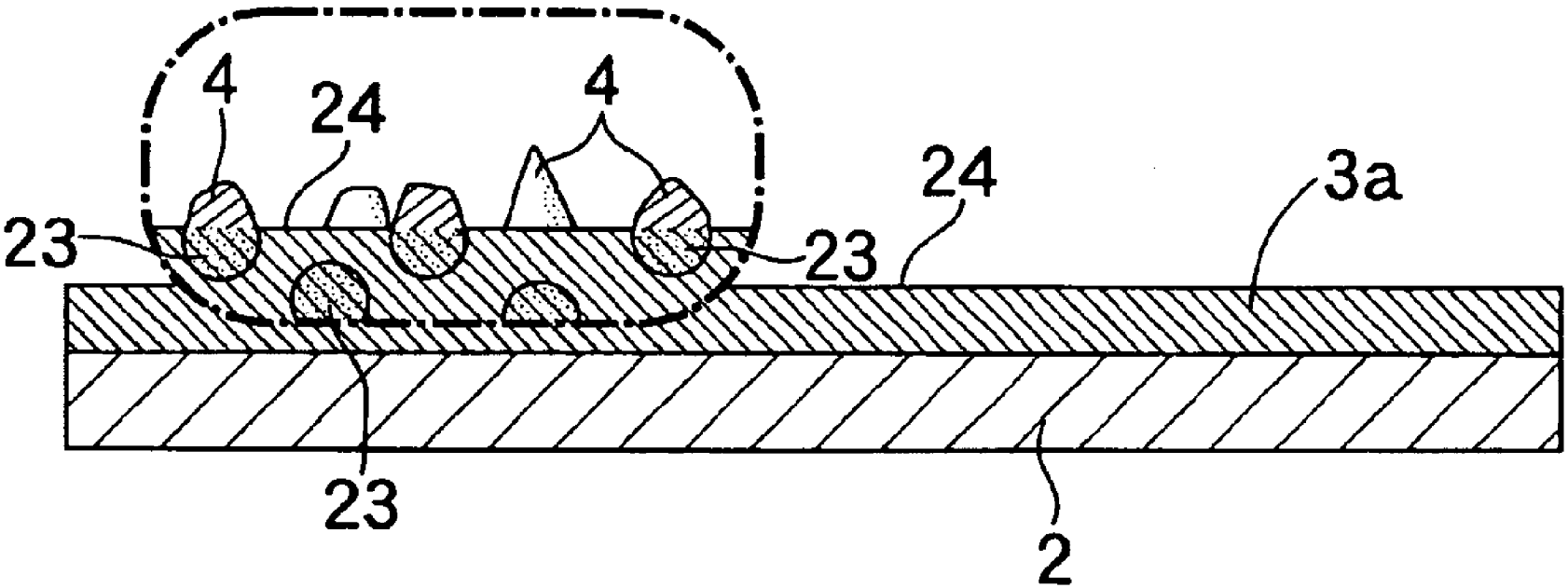
FIG. 11 is a view of the main body after being changed with the passage of time.

The main body 3*a* can be formed on the surface of the cathode plate 2 by the above-described process, as shown in FIG. 10. Cesium phases are dotted as the metal element portions 23 at a plurality of points both inside of the main body 3*a* and at the interface 24 of the main body 3*a* with the surface layer 3*b*. The plurality of cesium phases dotted at the interface 24 as shown in FIG. 11 are oxidized with the passage of time to form cesium oxide, and the projections 4 are formed from the cesium oxide.

Then, a negative ion beam depositing process similar to that described above can be carried out, such that a surface layer 3*b* made of an amorphous film of carbon is formed on the interface 24 of the main body 3*a* and bonded to the main body 3*a*. Thus, the surface layer 3*b* has a plurality of protrusions 25 formed to conform to the plurality of projections 4, as shown in FIG. 8. A cold cathode element 3 produced in the above manner is defined as example B1.

Figure 12:
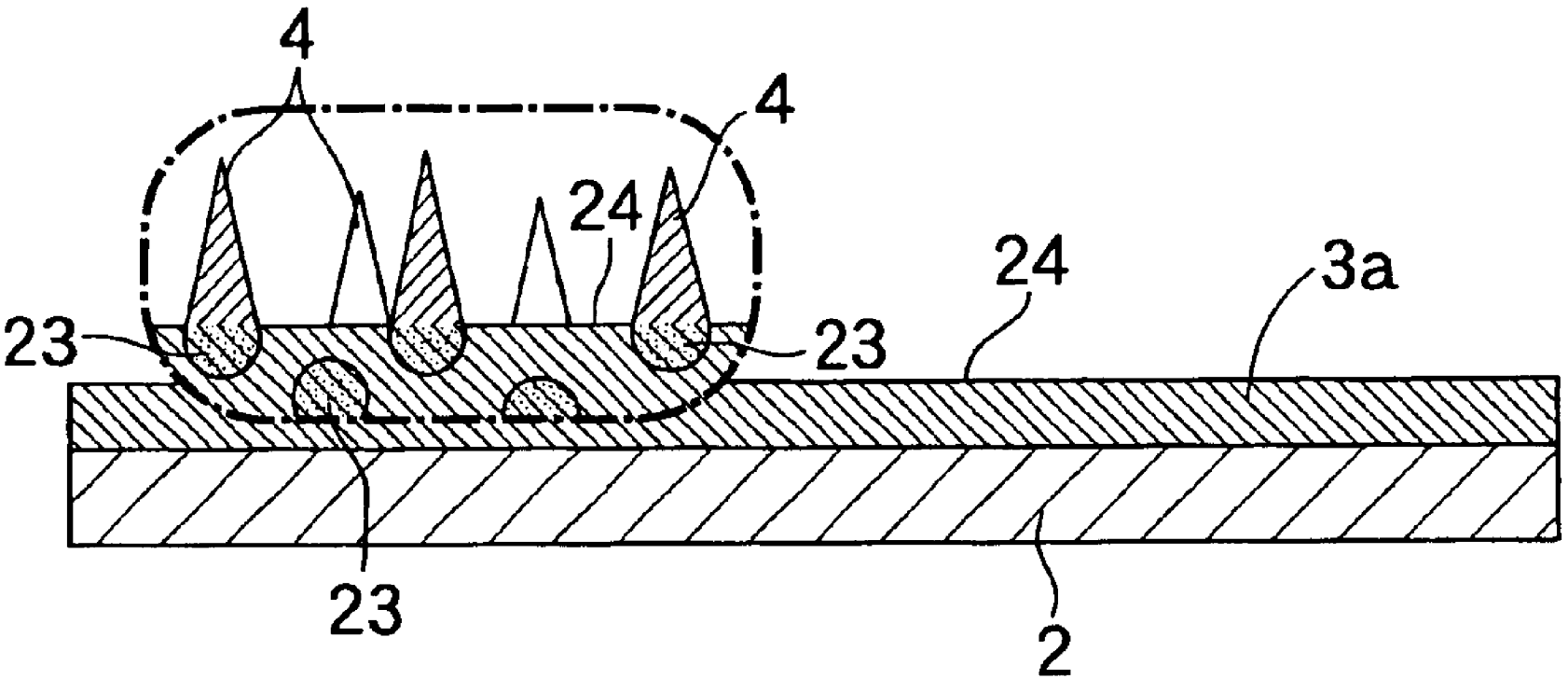
FIG. 12 is a sectional view of a third exemplary embodiment of a cathode unit according to the present invention.

For comparison, a main body 3*a* similar to the main body described above was formed on the surface of a cathode plate 2 by a process similar to the above-described process and left to stand in the atmosphere. As a result, substantially all of the projections 4 made of cesium oxide and dotted in the interface 24 were grown into a conical shape, as shown in FIG. 12. A cold cathode element 3 produced from such a main body 3*a* is defined as example B2.

Table 3 shows conditions for forming the examples B1 and B2 by the negative ion beam depositing process.

TABLE 3

| | Deposition energy (eV) | Extracting voltage (kV) | Voltage-current (V-A) of filament | Film forming time (hr) |
|---|---|---|---|---|
| Example B1 | | | | |
| Main body | 600 | 8 | 13.2–22 | 6 |
| Surface layer | 200 | 10 | 13.6–22.4 | 1 |
| Example B2 | 600 | 8 | 13.2–22 | 6 |

After formation of the main body 3*a* of the example B1, a substantially central portion of the main body 3*a* was subjected to a Raman spectroscopic analysis to examine whether the substantially central portion was amorphous. As a result, a broad Raman band was observed, as in FIG. 4, and it was ascertained from this that the main body 3*a* was amorphous. Results similar to that in FIG. 4 were also obtained for the surface layer 3*b* and the comparative example.

Figure 13:
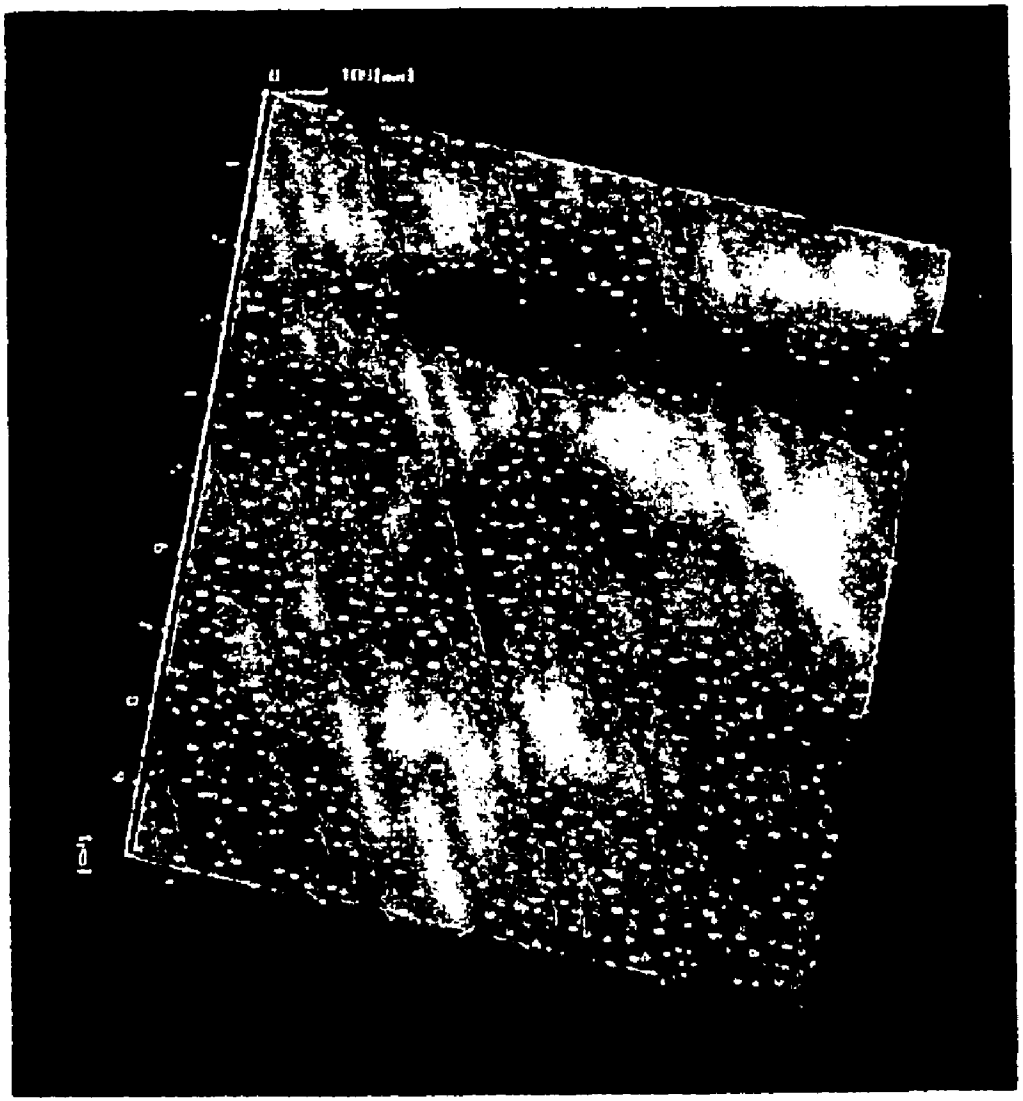
FIG. 13 is a photograph of the surface of a surface layer by an interatomic force microscope.
Figure 14:
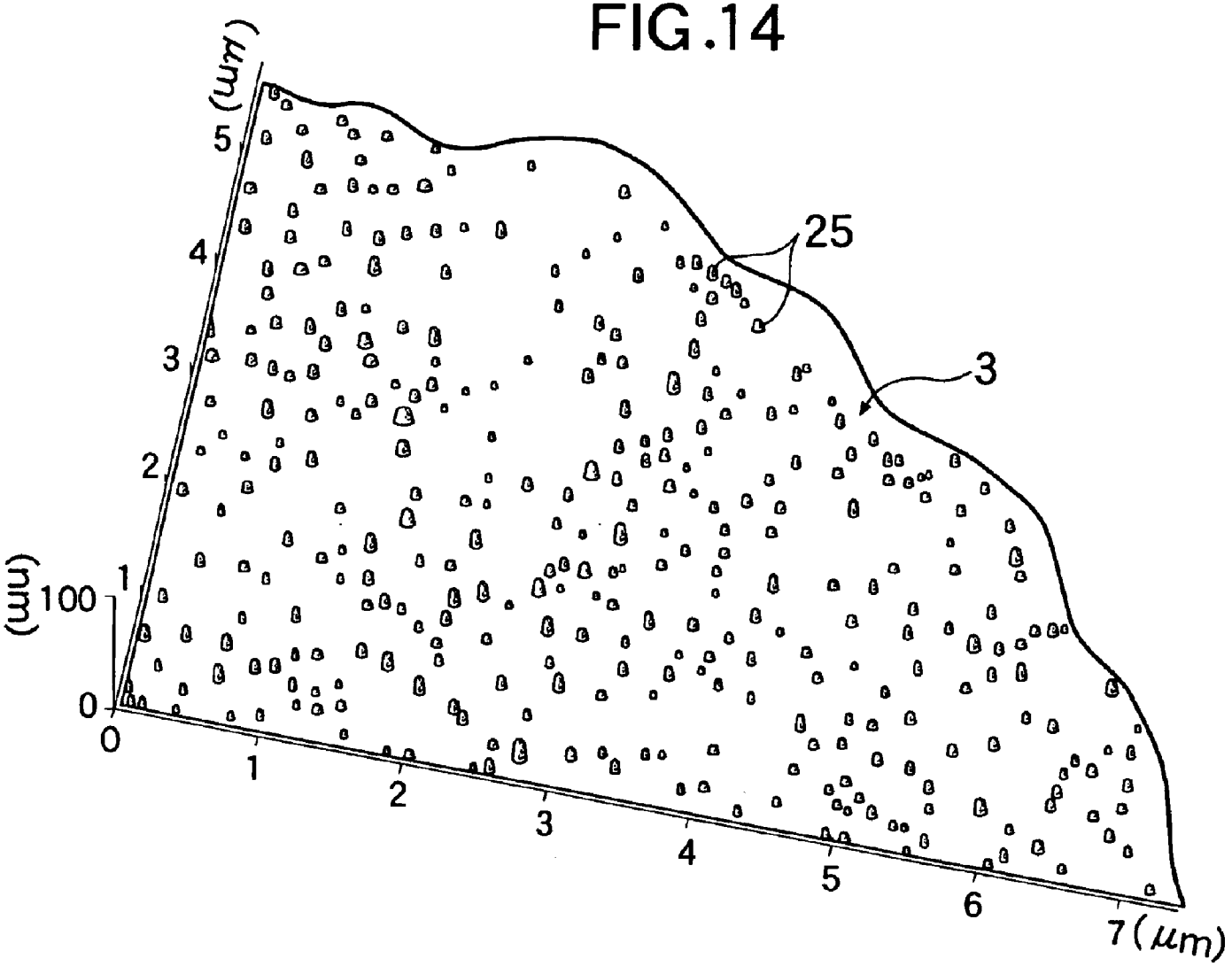
FIG. 14 is an enlarged tracing of an essential portion of the surface shown in FIG. 13.

Photographs of the surfaces of the examples B1 and B2 were taken by an interatomic force microscope (AFM). FIG. 13 is the photograph of the surface of the example B1, and FIG. 14 is an enlarged tracing of an essential portion of the photograph shown in FIG. 13. It can be seen from these Figures that a large number of protrusions 25 are dotted along the surface. In the case of the example B2, results similar to those shown in FIGS. 5 and 6 were obtained, and it was ascertained that a large number of conical projections 4 were dotted along the surface.

Further, the examples B1 and B2 were examined using a scanning electronic microscope (SEM) and as a result, the presence of cesium (metal element 23) in the inside of each of the examples B1 and B2 was observed.

Yet further, a secondary electron image on the surface of each of the examples B1 and B2 was photographed by Auger electron spectroscopy (AES). As a result, the presence of cesium on the surface of the surface layer 3*b* of the example B1 was not observed, but the presence of cesium on the surface of the example B2 was observed.

Yet further, the measurement of the emitted electric field was carried out for the examples 81 and B2 by a method similar to that described above (see FIG. 7 and page 8, lines 6 to 14). As a result, the emitted electric field was of 0.8 V/$\mu$m in the example B1, and 1.2 V/$\mu$m in the example B2. Thus, it was ascertained that the example 1 had sufficiently low emitted electric field, as compared with the example B2.

Even when the main body 3*a* does not contain a metal element 23 as described above, a corresponding effect is provided.

The cold cathode element in each of the first and second embodiments may be applied to a flat panel display, a voltage amplifying element, a high frequency amplifying element, a high-accuracy close-range radar, a magnetic sensor, a visual sensor and the like.

What is claimed is:

1. An electronic element comprising a deposited film containing cesium, said deposited film comprising a plurality of projections composed of cesium oxide on a surface thereof.

2. An electronic element according to claim 1, wherein said deposited film comprises an amorphous film of carbon, and said projections are conical and have an average height h in a range of 10 nm$\leqq$h$\leqq$500 nm.

3. An electronic element according to claim 2, wherein said amorphous film of carbon is formed by an ion beam deposition process using a negative ion beam.

4. An electronic element according to claim 2, wherein said amorphous film of carbon is a cold cathode element which emits electrons when an electric filed is applied to said cold cathode element.

5. An electronic element according to claim 3, wherein said amorphous film of carbon is a cold cathode element which emits electrons when an electric field is applied to said cold cathode element.

6. An electronic element, comprising a main body that is formed of an amorphous film of carbon and that contains a metal element having a metal bond radius equal to or larger than two times the atom radius of carbon, and a surface layer that covers said main body and is formed of an amorphous film of carbon having a high $sp^3$ hybridization.

7. An electronic element according to claim 6, wherein said surface layer, a half-value width Hw of a photoelectron spectrum of $C_{15}$ electrons by an X-ray photoelectron spectroscopic analysis is equal to or smaller than 2.0 eV.

8. An electronic element according to claim 6, wherein said main body has, on an interface thereof to said surface layer, a plurality of projections containing said metal element, and said surface layer has a plurality of protrusions formed to conform to said projections.

9. An electronic element according to claim 7, wherein said main body has, on an interface thereof to said surface layer, a plurality of projections containing said metal element, and said surface layer has a plurality of protrusions formed to conform to said projections.

10. An electronic element according to claim 8, wherein said metal element is cesium or rubidium.

11. An electronic element according to claim 9, wherein said metal element is cesium or rubidium.

12. An electronic element according to claim 10, wherein each of said main body and said surface layer is formed by an ion beam deposition process.

13. An electronic element according to claim 11, wherein each of said main body and said surface layer is formed by an ion beam deposition process.

14. An electronic element according to claim 12, wherein said electronic element is used as a cold cathode element that emits electrons with application of an electric field to said cold cathode element.

15. An electronic element according to claim 13, wherein said electronic element is used as a cold cathode element that emits electrons with application of an electric field to said cold cathode element.

16. An electronic element comprising a main body composed of an amorphous film of carbon, and a surface layer that covers said main body and that is formed of an amorphous film of carbon having a high $sp^3$ hybridization, wherein said amorphous film of carbon contains cesium.

17. An electronic element according to claim 16, wherein said electronic element is used as a cold cathode element that emits electrons with application of an electric field to said cold cathode element.

18. An electronic element according to claim 10, wherein said metal element is cesium contained in a range of form 0.1% by atom to 5.0% by atom in the amorphous film of carbon.

19. An electronic element according to claim 11, wherein said metal element is cesium contained in a range of form 0.1% by atom to 5.0% by atom in the amorphous film of carbon.

* * * * *